US011930971B2

(12) United States Patent
Rukavina et al.

(10) Patent No.: US 11,930,971 B2
(45) Date of Patent: Mar. 19, 2024

(54) FLOOR CLEANER

(71) Applicant: Techtronic Cordless GP, Anderson, SC (US)

(72) Inventors: Douglas M. Rukavina, Concord, NC (US); Donovan Bode, Charlotte, NC (US); Juan Aviles Quintero, Huntersville, NC (US); Gregory Clark, Charlotte, NC (US); Tyler Clas, Charlotte, NC (US); Mohammed Irfan, Huntersville, NC (US)

(73) Assignee: Techtronic Floor Care Technology Limited, Tortola (VG)

( * ) Notice: Subject to any disclaimer, the term of this patent is extended or adjusted under 35 U.S.C. 154(b) by 0 days.

(21) Appl. No.: 17/870,434

(22) Filed: Jul. 21, 2022

(65) Prior Publication Data

US 2022/0354328 A1 Nov. 10, 2022

Related U.S. Application Data

(63) Continuation of application No. 17/607,264, filed as application No. PCT/US2020/030942 on May 1, 2020, now Pat. No. 11,426,047.

(Continued)

(51) Int. Cl.

| | |
|---|---|
| ***A47L 11/20*** | (2006.01) |
| ***A47L 11/30*** | (2006.01) |
| ***A47L 11/40*** | (2006.01) |

(52) U.S. Cl.

CPC ..... *A47L 11/201* (2013.01); *A47L 11/302* (2013.01); *A47L 11/4075* (2013.01); *A47L 11/4088* (2013.01); *A47L 11/4094* (2013.01)

(58) Field of Classification Search

CPC . A47L 11/4075; A47L 11/4088; A47L 11/201

See application file for complete search history.

(56) References Cited

U.S. PATENT DOCUMENTS

| | | | |
|---|---|---|---|
| 5,784,755 | A | 7/1998 | Karr et al. |
| 5,839,159 | A | 11/1998 | Karr et al. |

(Continued)

FOREIGN PATENT DOCUMENTS

| | | | |
|---|---|---|---|
| CN | 102015119 | A | 4/2011 |
| CN | 105979842 | A | 9/2016 |

(Continued)

OTHER PUBLICATIONS

Examination Report No. 1 issued by the Australian Government for Application No. 2020269265 dated Sep. 7, 2022 (4 pages).

(Continued)

*Primary Examiner* — Andrew A Horton

(74) *Attorney, Agent, or Firm* — Michael Best & Friedrich LLP

(57) ABSTRACT

A floor cleaner including a base movable over a surface to be cleaned, a suction nozzle provided on the base having a suction inlet, a body portion having a fluid dispensing member selectively removable from the body portion, the body portion being pivotally mounted to the base movable between an upright storage position and an inclined floor cleaning position, a suction source in fluid communication with the suction nozzle, and a reservoir configured to provide solution. The fluid dispensing member includes a grip, a dispensing nozzle in fluid communication with the reservoir, and an actuator. The fluid dispensing member is configured to deliver solution from the reservoir through the dispensing nozzle upon user actuation of the actuator, independent of function of the base and body of the floor cleaner.

25 Claims, 15 Drawing Sheets

Related U.S. Application Data

(60) Provisional application No. 62/906,545, filed on Sep. 26, 2019, provisional application No. 62/842,909, filed on May 3, 2019.

(56) References Cited

U.S. PATENT DOCUMENTS

| | | | |
|---|---|---|---|
| 5,887,313 | A | 3/1999 | Hanold et al. |
| 5,933,912 | A | 8/1999 | Karr et al. |
| 6,041,472 | A | 3/2000 | Kasen |
| 6,082,376 | A | 7/2000 | Karr et al. |
| 6,574,831 | B2 | 6/2003 | Hunter et al. |
| 6,609,268 | B2 | 8/2003 | Miner |
| 6,775,880 | B2 | 8/2004 | Kasper et al. |
| 6,848,145 | B2 | 2/2005 | Lee et al. |
| 6,886,214 | B2 | 5/2005 | Lee et al. |
| 7,203,991 | B2 | 4/2007 | Stephens et al. |
| 7,484,265 | B2 | 2/2009 | Kasper et al. |
| 7,725,985 | B2 | 6/2010 | Krebs |
| 8,122,562 | B2 | 2/2012 | Krebs |
| 8,230,550 | B2 | 7/2012 | Krebs et al. |
| 8,381,352 | B2 | 2/2013 | Huffman et al. |
| 8,850,654 | B2 | 10/2014 | Nolan et al. |
| 9,186,028 | B2 | 11/2015 | White et al. |
| 9,409,213 | B2 | 8/2016 | Huffman et al. |
| 9,433,335 | B2 | 9/2016 | Nolan et al. |
| 9,867,517 | B2 | 1/2018 | Krebs et al. |
| 10,178,934 | B2 | 1/2019 | Huffman et al. |
| 2002/0092117 | A1* | 7/2002 | Kasper ..... A47L 11/4088 15/328 |
| 2006/0272120 | A1 | 12/2006 | Barrick et al. |
| 2008/0196193 | A1 | 8/2008 | Huffman |
| 2009/0126144 | A1 | 5/2009 | Kasper et al. |
| 2009/0126800 | A1 | 5/2009 | Kasper et al. |
| 2016/0360943 | A1 | 12/2016 | Krebs et al. |
| 2018/0333736 | A1* | 11/2018 | Krebs ..... A47L 5/365 |
| 2019/0059679 | A1 | 2/2019 | Huffman et al. |
| 2021/0127931 | A1 | 5/2021 | Bloomer et al. |

FOREIGN PATENT DOCUMENTS

| | | | |
|---|---|---|---|
| CN | 106102540 | A | 11/2016 |
| CN | 206151378 | U | 5/2017 |
| CN | 108567387 | A | 9/2018 |
| GB | 2447338 | A | 9/2008 |

OTHER PUBLICATIONS

Chinese Patent Office Action for Application No. 202080037936.5 dated Jan. 12, 2023 (5 pages including statement of relevance).
International Search Report and Written Opinion for Application No. PCT/US2020/030942 dated Sep. 8, 2020 (14 pages).
Chinese Patent Office Action for Application No. 202080037936.5 dated May 7, 2022 (13 pages including statement of relevance).

* cited by examiner

FLOOR CLEANER

CROSS-REFERENCE TO RELATED APPLICATIONS

This application is a continuation of U.S. patent application Ser. No. 17/607,264, filed Oct. 28, 2021, which is a U.S. National Phase of International Patent Application No. PCT/US2020/030942, filed May 1, 2020, which claims priority to U.S. Provisional Patent Application No. 62/842,909 filed May 3, 2019 and to U.S. Provisional Patent Application No. 62/906,545, filed Sep. 26, 2019, the entire contents all of which are hereby incorporated by reference herein.

BACKGROUND

The present invention relates to a floor cleaner.

SUMMARY

In one embodiment, a floor cleaner includes a body having a fluid recovery system. The fluid recovery system includes a suction nozzle having a suction inlet, a recovery tank in fluid communication with the suction nozzle by a fluid passageway, and a suction source configured to draw fluid from the suction nozzle to the recovery tank. The floor cleaner further includes a fluid dispensing member selectively releasably attached to the body. The dispensing member includes a grip, a fluid supply tank, a dispensing nozzle in fluid communication with the supply tank, a pump connecting the supply tank to the dispensing nozzle, a power source, and an actuator electrically connected to the power source and the pump. The pump is configured to dispense fluid through the dispensing nozzle when the dispensing member is released from the body and the actuator is actuated by a user.

In another embodiment, a floor cleaner is disclosed including a base movable over a surface to be cleaned, a body connected to the base, a first fluid distribution system, and a second fluid distribution system. The first fluid delivery system is supported by the base or the body and includes a first fluid supply tank, a first dispensing nozzle in fluid communication with the first fluid supply tank, the first dispensing nozzle configured to provide a fluid to a surface to be cleaned, and a fluid recovery system. The second fluid distribution system operates independently of the first fluid distribution system. The second fluid distribution system is selectively releasably attached to the body and includes a grip, a second fluid supply tank, a second dispensing nozzle in fluid communication with the second supply tank, a pump connecting the second supply tank to the second dispensing nozzle, a power source, and an actuator electrically connected to the power source and the pump. The pump is configured to dispense fluid through the second dispensing nozzle when the second fluid distribution system is released from the body and the actuator is actuated by a user.

In another embodiment, a floor cleaner includes a base movable over a surface to be cleaned, a suction nozzle provided on the base having a suction inlet, a body portion having a handle assembly selectively removable from the body portion, the body portion being pivotally mounted to the base movable between an upright storage position and an inclined floor cleaning position, a suction source in fluid communication with the suction nozzle configured to convey air from the suction nozzle to an air outlet, and a reservoir configured to provide solution. The handle assembly includes a grip, a dispensing nozzle in fluid communication with the reservoir, and an actuator. The handle assembly has a first position in which the handle assembly is mounted to the body portion and a second position in which the handle assembly is released from the body portion. The handle assembly is configured to steer the floor cleaner along the surface to be cleaned in the first position. The actuator is configured to deliver solution from the reservoir through the nozzle when the handle assembly is in the second position.

In another embodiment, a floor cleaner is disclosed including a base movable over a surface to be cleaned, a body portion having a handle assembly selectively removable from the body portion, the body portion being pivotally mounted to the base movable between an upright storage position and an inclined floor cleaning position, and a liquid distribution system. The liquid distribution system includes a supply tank, an actuator, and a dispensing nozzle in fluid communication with the supply tank to deliver a solution to a surface to be cleaned. The handle assembly includes a dispensing nozzle. The handle assembly has a first position in which the handle assembly is mounted to the body portion and a second position in which the handle assembly is released from the body portion.

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Other aspects of the invention will become apparent by consideration of the detailed description and accompanying drawings.

DETAILED DESCRIPTION

Figure 1:
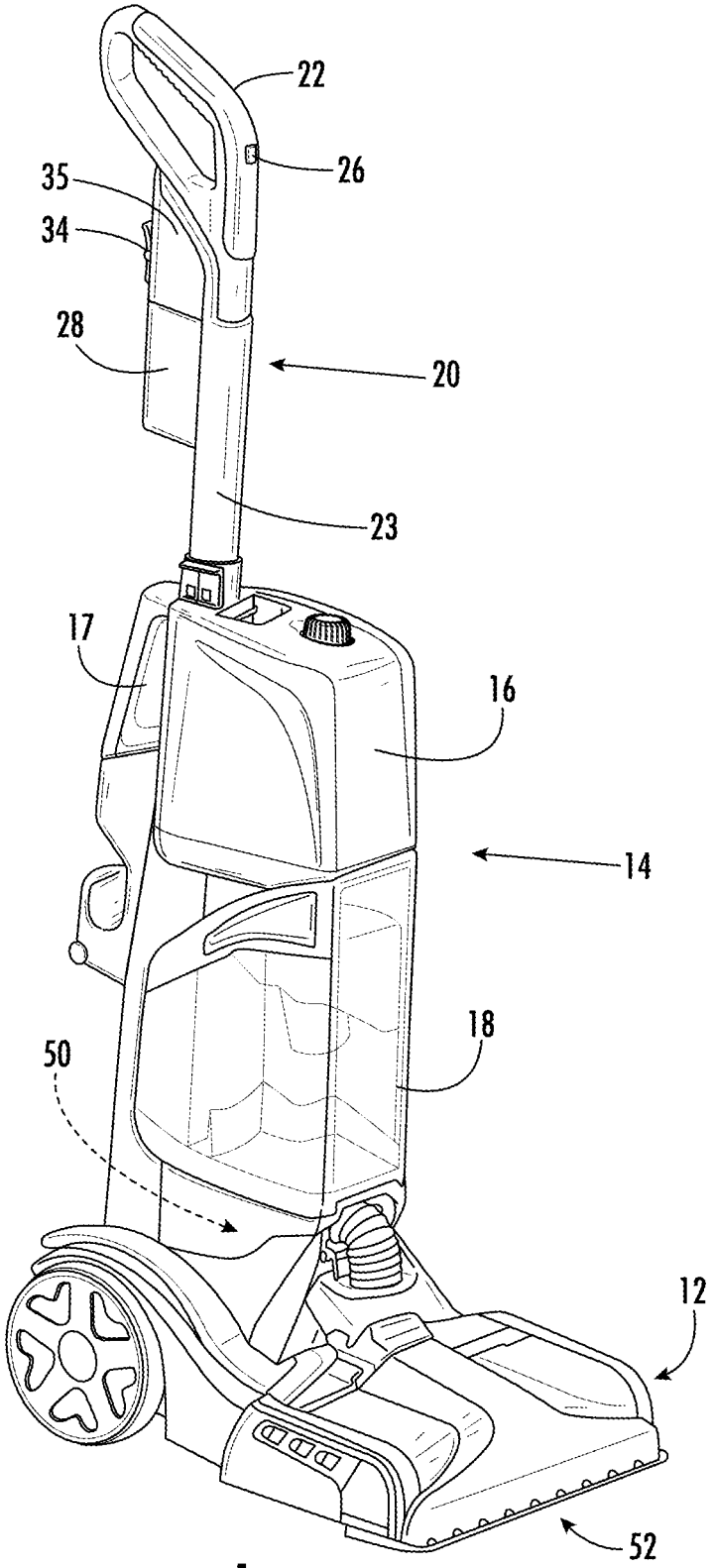
FIG. 1 illustrates a perspective view of a surface cleaning device.

FIG. 1 illustrates a floor cleaner 10 with a base 12 movable over a surface to be cleaned, a body portion 14 pivotally mounted to the base 12, and a fluid dispensing member 20 removably mounted to the body portion 14. In the illustrated embodiment, the fluid dispensing member is a handle assembly 20. The handle assembly 20 is configured to include a dispensing nozzle 24. During operation of the floor cleaner 10, it may be useful to remove the fluid dispensing member 20 from the body portion 14, for example, for spot treatment cleaning. The use of the handle assembly 20 as a dispensing member enables a solution to be applied to the surface to be cleaned with a degree of accuracy as to the position and region of application. When the handle assembly 20 is removed from the body portion 14, the user is able to apply a spot treatment to a targeted area of the surface to be cleaned remote from the floor cleaner 10 via the dispensing nozzle 24.

In the illustrated embodiment, the handle assembly 20 and the body portion 14 are pivotal relative to the base 12 between an upright storage position (FIG. 1) and an inclined floor cleaning position. The floor cleaner 10 includes one or more tanks for storing liquid and is configured to distribute cleaning solution to the floor. In the illustrated embodiment, the floor cleaner 10 includes a supply tank 16 for providing water or other cleaning solution, optionally, a detergent tank 17, a spot treatment tank 28, and a recovery tank 18 for collecting dirty liquid extracted from the surface being cleaned. The spot treatment tank 28, further discussed below, allows the user to apply spot treatment solution to a localized portion of a surface to be cleaned. The supply tank 16 and detergent tank 17 may be positioned on the body portion 14, the fluid dispensing member 20, or operatively coupled to the base 12.

Figure 10:
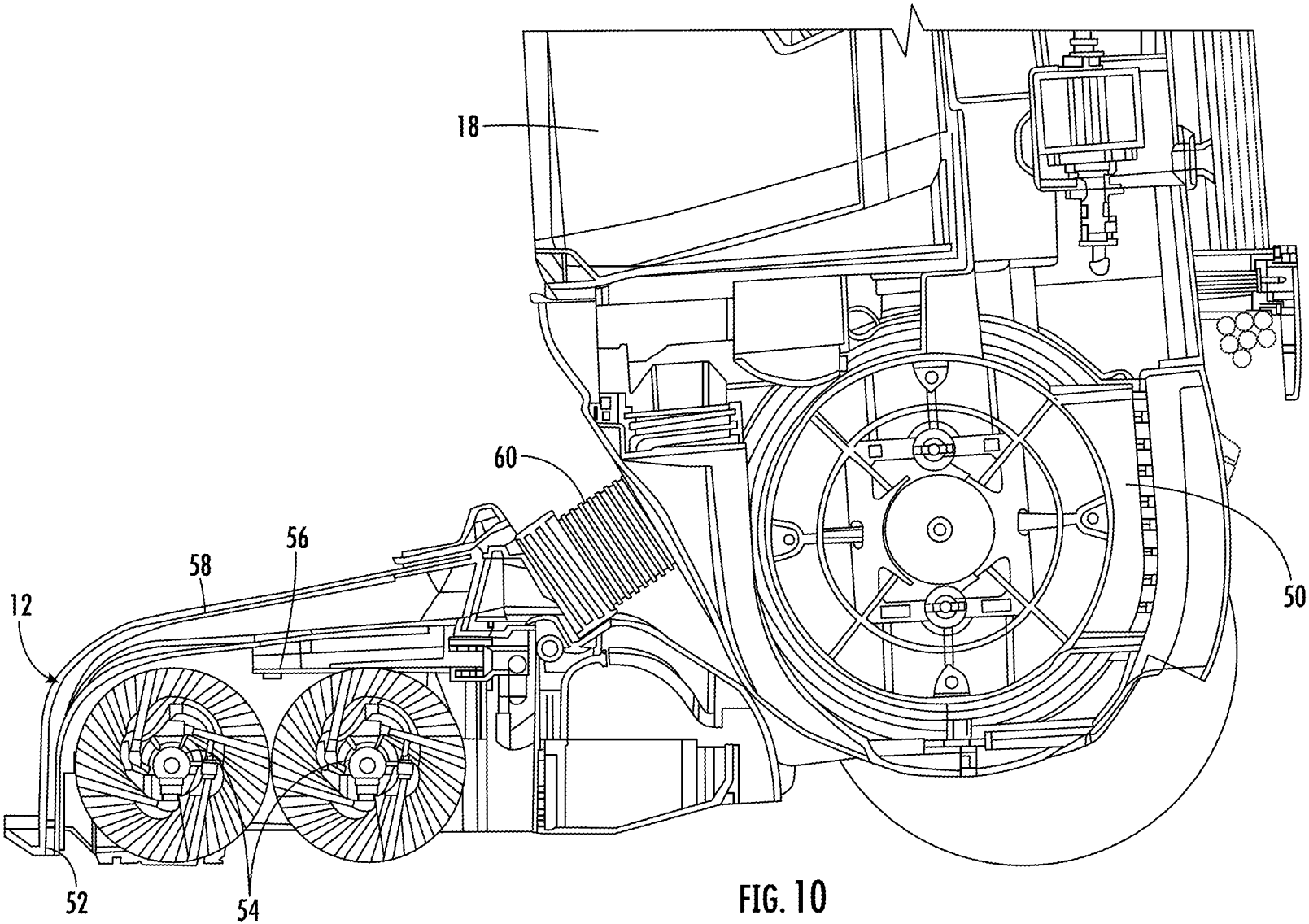
FIG. 10 illustrates a cross-sectional view of a base of the surface cleaning device

Referring to FIG. 10, the base 12 has a fluid distribution system including a fluid distributer 56 in fluid communication with the supply tank 16 and the detergent tank 17. The fluid distributer 56 distributes solution from the supply tank 16 and/or the detergent tank 17 to the surface to be cleaned. The base 12 may include one or more brushrolls 54 to agitate and scrub the cleaning solution on the surface to dislodge embedded dirt or debris. In one embodiment, the floor cleaner 10 includes a first fluid distribution system and a second fluid distribution system. In this embodiment, the first fluid distribution system includes the fluid distributer 56 on the base 12 in fluid communication with the supply tank 16. The second fluid distribution system includes the fluid dispensing member 20, and is operable independent of the first fluid distribution system. The second fluid distribution system also includes a grip portion 22, a second fluid supply tank or spot treatment tank 28, the dispensing nozzle 24, a pump 30 connecting the second supply tank 28 to the dispensing nozzle 24, a power source, and an actuator 26 electrically connected to the power source and pump 30.

Referring again to FIG. 10, optionally the applied cleaning solution is extracted from the surface by a fluid recovery system. In one embodiment, the fluid recovery system includes a mop pad or other absorbent media disposed on the base 12 of the floor cleaner. In one embodiment, the fluid recovery system includes a suction nozzle 58, a recovery tank 18, and a suction source 50. In the illustrated embodiment, the suction nozzle 58 has a suction inlet 52 at least partially spanning the front portion of the base 12. The suction nozzle 58 is in fluid flow communication with the recovery tank 18 by way of an air duct 60 operatively coupled between the base 12 and the body portion 14. The suction source 50, housed in the body portion 14 draws air and liquid through the suction nozzle 52 and the air duct 60 of the base 12, through an air/liquid separator in the recovery tank 18, to then exhaust the air to the atmosphere leaving separated liquid in the recovery tank 18. In other embodiments, the suction source 50 may be housed in a different portion of the floor cleaner 10, such as the base 12. During operation, the floor cleaner 10 distributes cleaning solution to the surface, while simultaneously or sequentially extracting and recovering the applied cleaning solution in a continuous operation.

In the illustrated embodiment, the recovery tank 18 is removably coupled to the body portion 14 to allow a user to remove the recovery tank 18 and empty the liquid contents. In other embodiments, the recovery tank 18 may be operatively coupled to another portion of the floor cleaner 10, such as the base 12. In one embodiment, the floor cleaner 10 is not an extractor and does not include a suction source and recovery tank. In one embodiment without a suction source and recovery tank, the base includes a mop pad or other absorbent media for fluid recovery.

The handle assembly 20 includes the grip portion 22, the dispensing nozzle 24 in fluid communication with the spot treatment tank 28 or other supply tank or reservoir, and the actuator 26 configured to be activated by a user to dispense solution through the dispensing nozzle 24. The handle assembly 20 may be used as a fluid dispensing member independent of the fluid distribution system in the base 12 of the floor cleaner, as well as independent of the fluid recovery system of the floor cleaner. In one embodiment, the handle assembly 20 may be used as a fluid dispensing member remote from the fluid distribution system and the fluid recovery system of the floor cleaner. The fluid dispensing member may be used independently from the fluid recovery system, which means that the fluid dispensing member can be moved independently from the suction nozzle 52 or any other suction nozzle or other fluid recovery system on the floor cleaner 10 (such as one used with an accessory hose for above-floor cleaning). In contrast to known fluid dispensers associated with, affixed in proximity to, or attached to a suction nozzle of fluid recovery system for the purpose of depositing fluid onto a surface to be cleaned near the suction nozzle for convenient recovery, the handle assembly 20 is not associated with, affixed in proximity to, or attached to any suction nozzle of the floor cleaner 10 allowing the cleaning fluid to be deposited on the cleaning surface without immediate recovery thereby allowing the deposited cleaning fluid sufficient time treat stains on the surface.

The handle assembly 20 may include a wand 23 extending from the grip portion 22. In one embodiment, the grip portion 22 is in an upper portion of the handle assembly 20 and the dispensing nozzle 24 is positioned in a lower portion. The dispensing nozzle 24 may be positioned in the wand to dispense fluid through the wand 23 when the user activates the actuator 26.

The fluid dispensing member, here illustrated as the handle assembly 20, is selectively removable from the body portion. The handle assembly 20 includes a first position in which the handle assembly 20 is mounted to and movable with the body portion 14, and a second position in which the handle assembly 20 is released from and movable independently of the body portion 14. In one embodiment, the handle assembly 20 is configured to steer the floor cleaner 10 along the surface to be cleaned in the first position, or mounted position. When the handle assembly 20 is in the second position, removed from the body portion 14, the user is able to apply a spot treatment to a targeted area of the surface to be cleaned via the dispensing nozzle 24.

Figure 2:
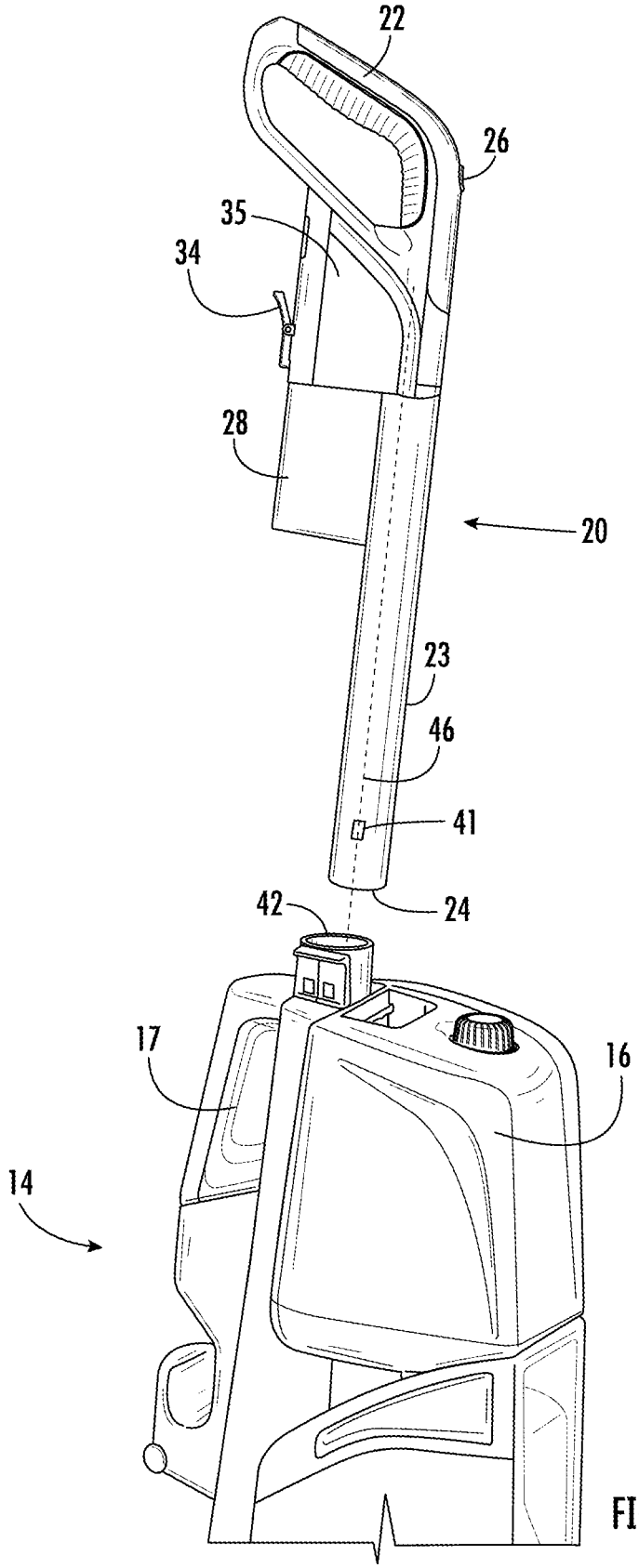
FIG. 2 illustrates an exploded view of an untethered handle assembly removed from a body portion of a floor cleaner.

The handle assembly 20 is received in an aperture or interior 42 of the body portion and removed from the interior 42 by pulling the handle assembly 20 out of the interior 42. In the illustrated embodiment, the aperture 42 forms a longitudinal axis 46 and the wand 23 slides into and out of the aperture 42 along the longitudinal axis 46. In one embodiment, the interior 42 may be a recess or pocket on the body portion 14 configured to receive a portion of the handle assembly 20. The handle assembly 20 is releasably attached to the body portion 14 using a latch 38 having a release button 40. In the illustrated embodiment, the body portion 14 includes the latch 38. In one embodiment, the handle assembly 20 includes the latch 38. The latch 38 includes a first retaining feature (not shown) that engages with a corresponding second retaining feature, such as a recess 41 (FIGS. 2 and 2*a*) on the handle assembly 20. The latch first retaining feature may be a hook, catch, protrusion, rib, recess, aperture, or other retaining feature as desired. The handle retaining feature 41 may be a hook, catch, protrusion, rib, recess, aperture, or other retaining feature corresponding to and engageable with the latch first retaining feature as desired to releasably couple the handle assembly 20 to the body portion 14. The user removes the handle assembly 20 from the cleaner 10 by pressing the release button 40 releasing the latch 38, and pulling the handle assembly 20 away from the body portion 14.

Figure 5:
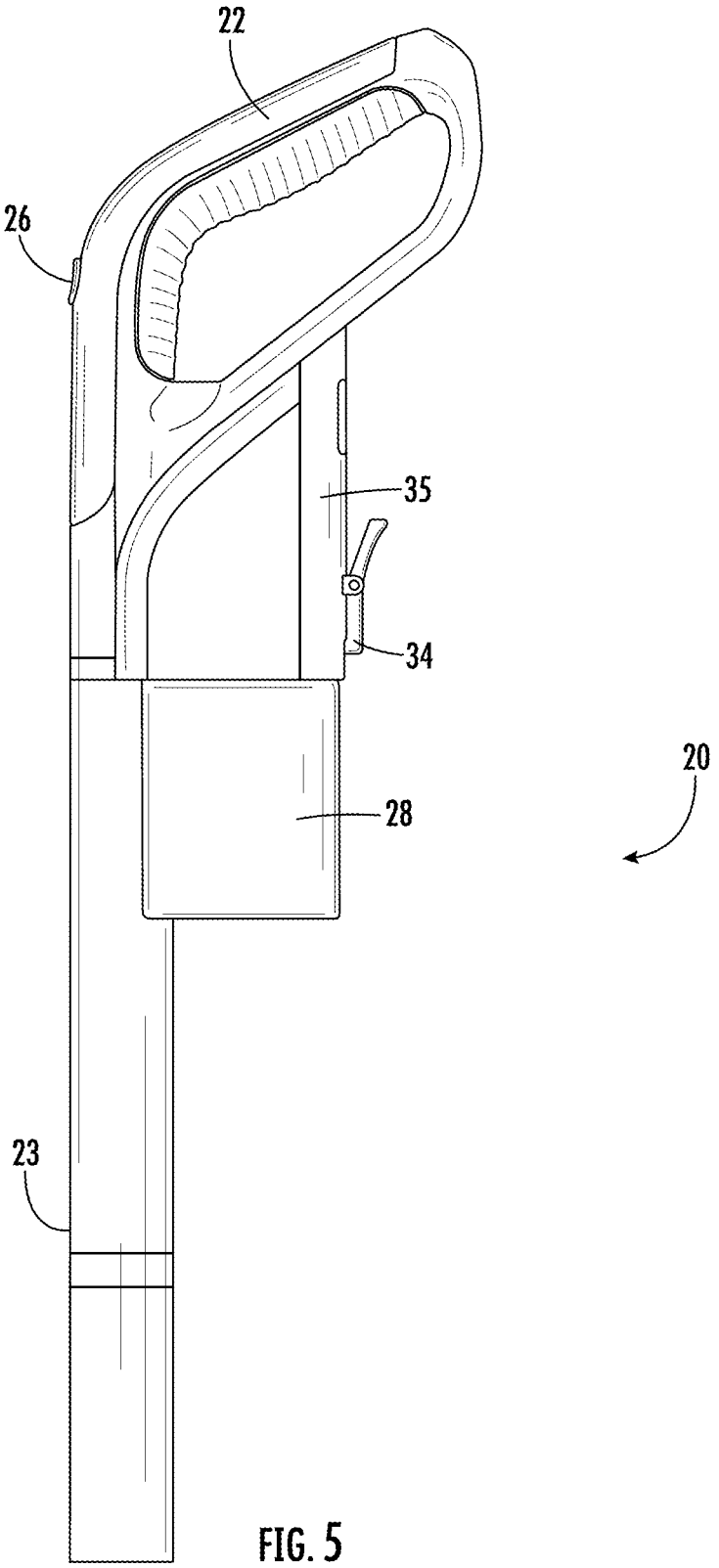
FIG. 5 illustrates a view of the handle assembly in the removed position.
Figure 6:
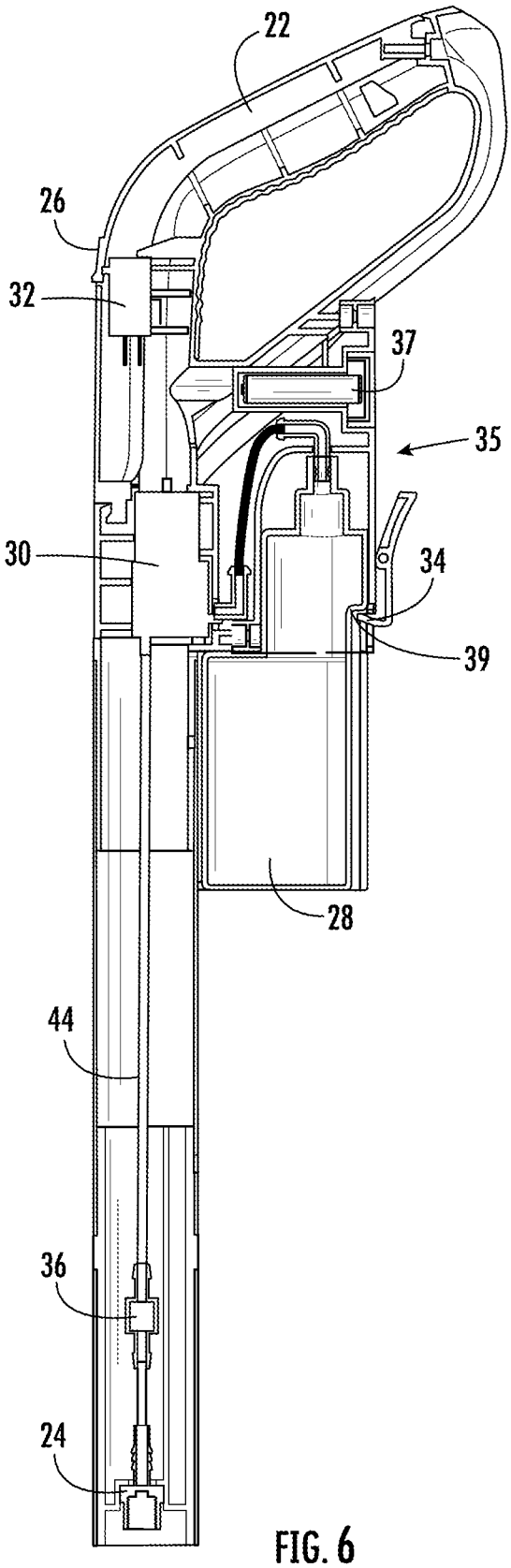
FIG. 6 illustrates a cross-sectional view of the handle assembly shown in FIG. 5.
Figure 7:
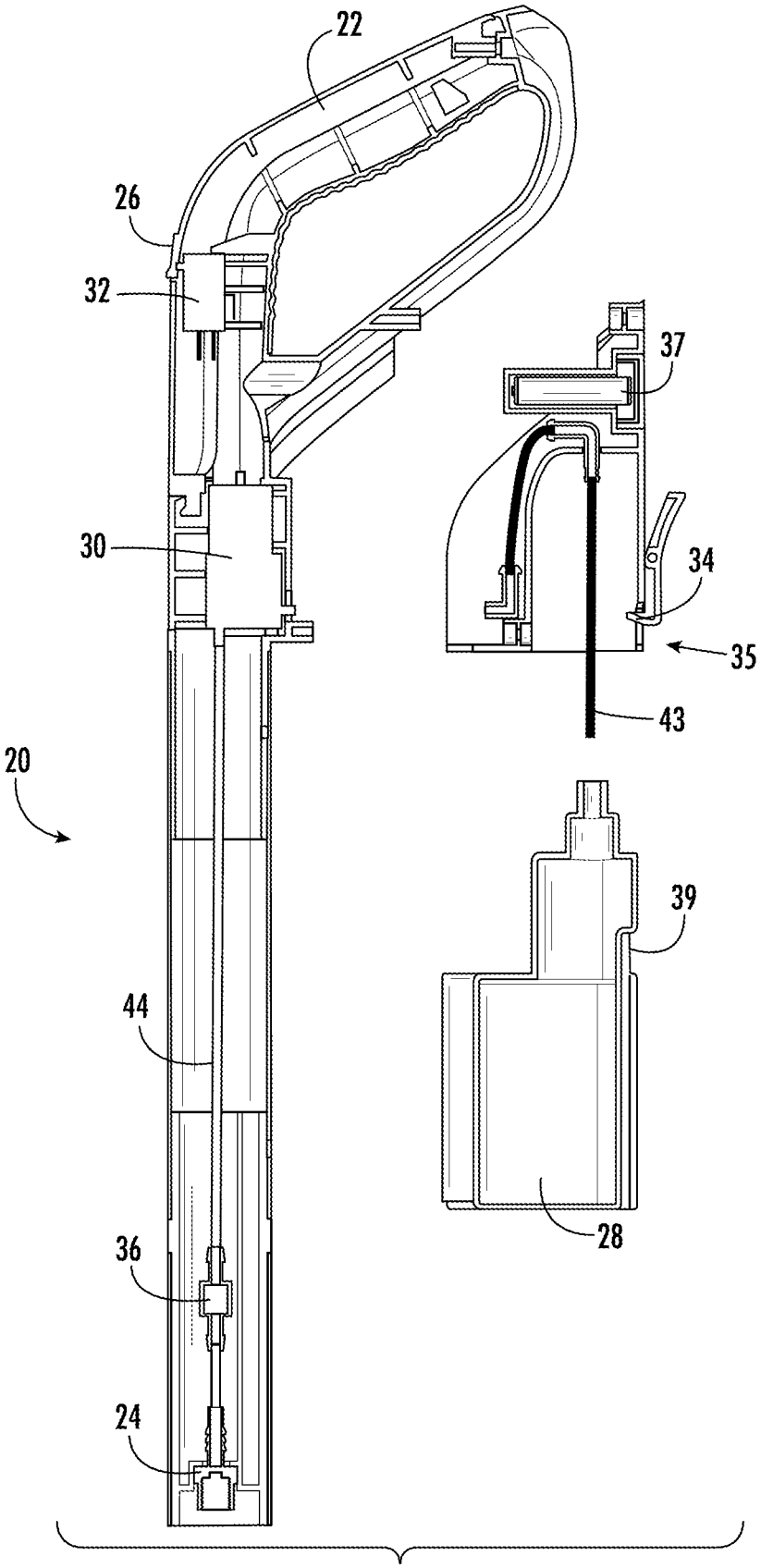
FIG. 7 illustrates an exploded cross-sectional view of the handle assembly shown in FIG. 5.

In the embodiment shown in FIGS. 5-7, the removable handle 20 includes the grip 22, the dispensing nozzle 24, the actuator 26, and the spot treatment tank 28. The spot treatment tank 28 is in fluid communication with the dispensing nozzle 24 of the handle assembly 20 via a supply tube 44. As shown in FIG. 6, the handle assembly 20 contains a pump 30 and a battery 37. Upon the user engaging the actuator 26, the actuator 26 activates a switch 32, such as a microswitch, that activates the pump 30. The pump 30 draws solution from the spot treatment tank 28 through a dip tube 43 (FIG. 7), then moves liquid through the supply tube 44, through a check valve 36 and out the dispensing nozzle 24. This arrangement allows the user to operate the removable handle 20 in an untethered and remote position, independent of the body portion 14 of the floor cleaner.

Further shown in the embodiment of FIGS. 6 and 7, the spot treatment tank 28 is operatively and removably coupled to the handle assembly 20 by a spot treatment housing 35. The spot treatment tank 28 is received into the spot treatment housing 35, and secured to the housing 35 by a latch 34. A latching feature, such as a recess 39 on the spot treatment tank 28 receives the latch 34 to secure the tank 28. The latch 34 secures the spot treatment tank 28 to the housing 35 and handle assembly 20. The spot treatment tank 28 is removable from the handle assembly 20 by releasing the latch 34 and pulling the tank 28 away from the housing 35. The spot treatment tank 28 may be a refillable container or may be a disposable container containing a single use amount of solution.

In one embodiment, the spot treatment tank 28 may be operatively and removably coupled to the body portion 14 of the floor cleaner 10 instead of being coupled to the fluid dispensing member 20. In this embodiment, the fluid dispensing member 20 is tethered to the body portion 14 by a tube fluidly connected to the spot treatment tank 28 configured to dispense solution from the fluid dispensing member 20 in the second position. In this embodiment, the pump may be on the fluid dispensing member 20 and powered by a battery to draw fluid from the spot treatment tank on the body portion through the tube to the dispensing nozzle 24. In one embodiment, the fluid dispensing member is tethered to the body portion by an electrical connection, wherein the pump on the fluid dispensing member is powered through the electrical connection in the tether. In an alternate embodiment, the pump and the spot treatment tank may both be on the body portion 14 and fluidly connected to the dispensing nozzle 24 on the fluid dispensing member 20.

Figure 2A:
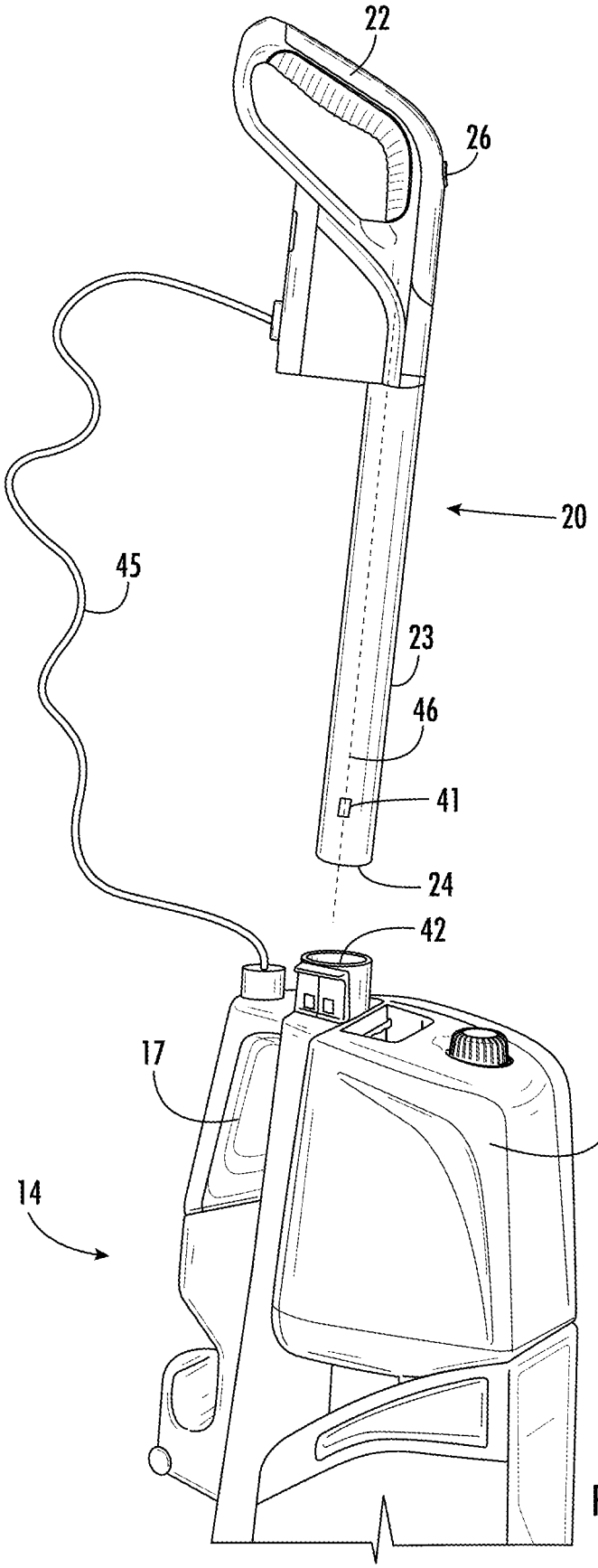
FIG. 2*a* illustrates an exploded view of a tethered handle assembly removed from a body portion of a floor cleaner.
Figure 3:
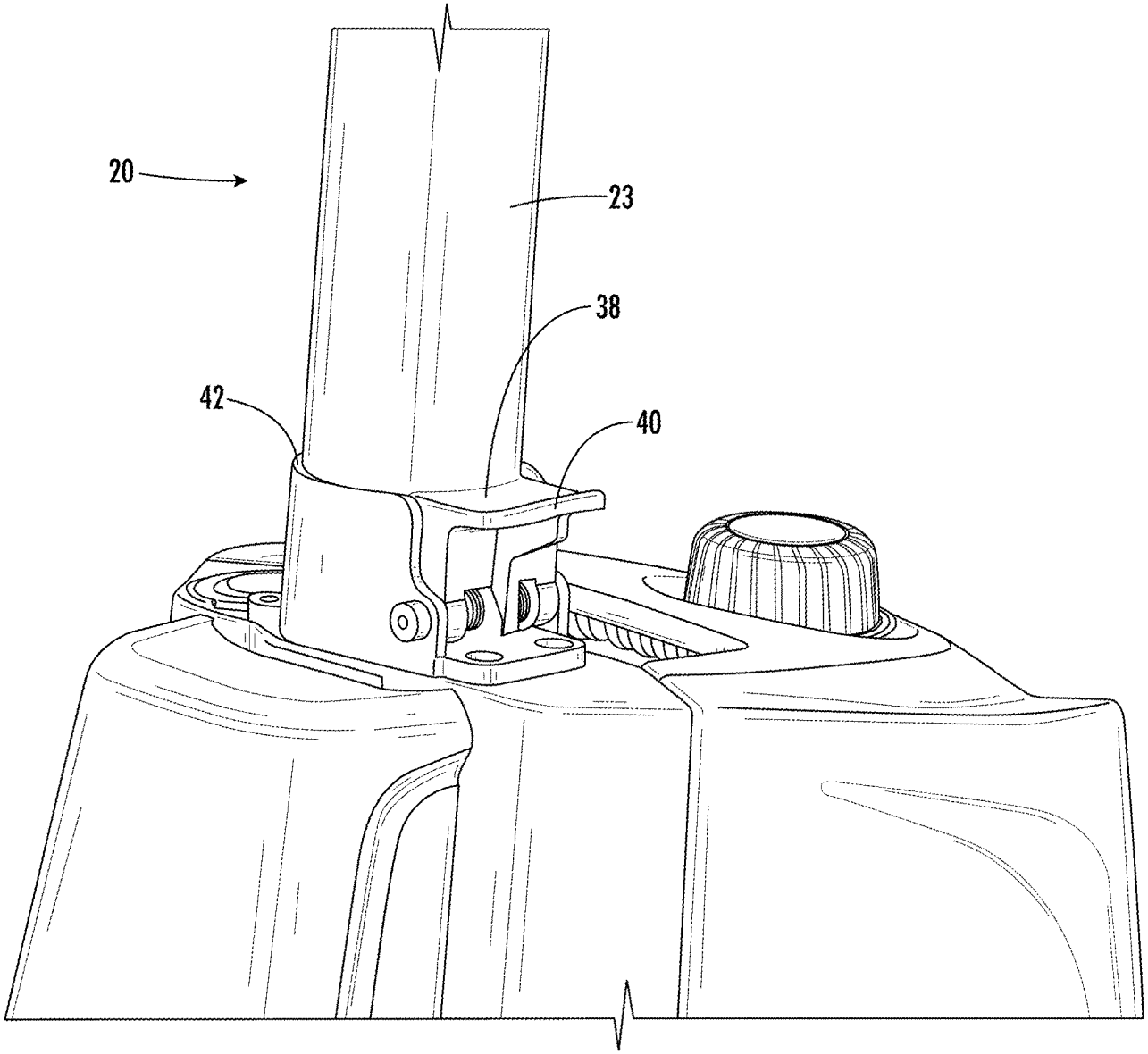
FIG. 3 illustrates an enlarged view of the connection point of the handle assembly and the body portion of the floor cleaner.
Figure 4:
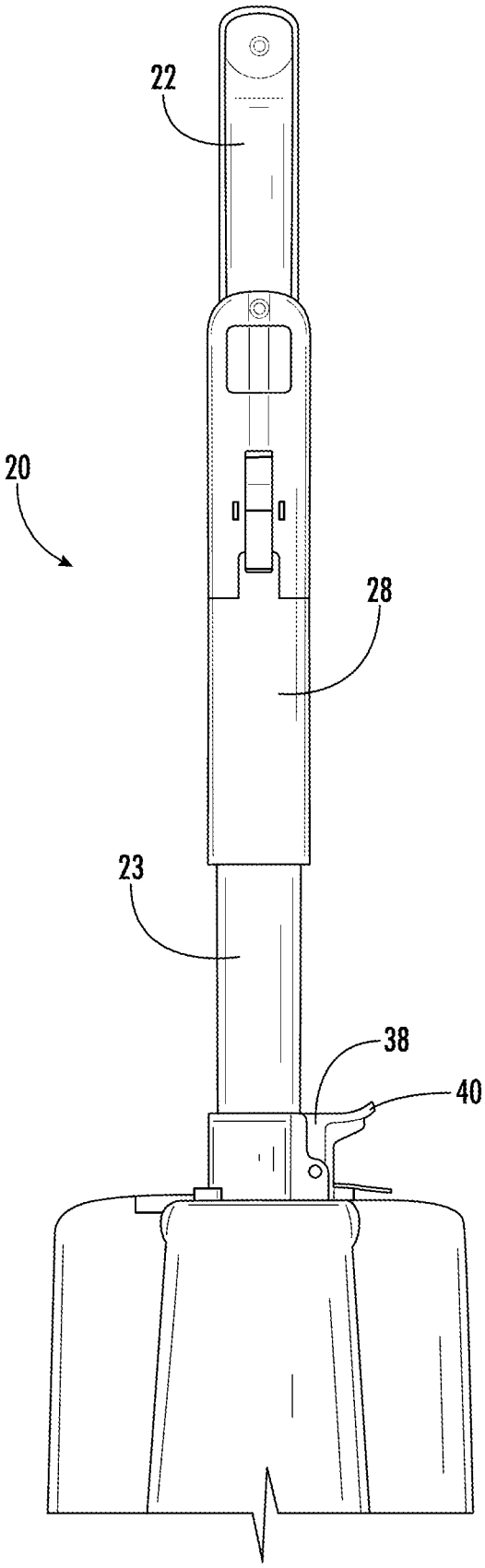
FIG. 4 illustrates a back perspective view of the floor cleaner shown in FIG. 3.

In the embodiment shown in FIG. 2*a*, instead of a spot treatment tank, the fluid dispensing member 20 is fluidly connected to the supply tank 16 and/or the detergent tank 17 tethered by a tube 45 to provide cleaning solution to the fluid dispensing member 20 in the second position. In this embodiment, the pump may be in the fluid dispensing member 20 and powered by a battery or powered by an electrical connection from the body portion 14, or the pump may be on the body portion 14 of the floor cleaner 10. In one embodiment, the supply tank 16 and/or detergent tank 17 are removable from the body portion 14 while fluidly connected to the fluid dispensing member 20 to enable the user to apply spot treatment remote from the floor cleaner 10.

The pump 30 may be manually operated or electrically operated. In the illustrated embodiment, the pump 30 is powered by battery 37. The pump 30 is activated by the actuator 26. The actuator 26 may be a button, trigger, switch, or similar actuation mechanism. In operation, the user presses the actuator 26 to energize the pump for an electrical pump, or presses the actuator to drive a mechanical pump, to move cleaning solution from the spot treatment tank 28 through the dispensing nozzle 24 located on the fluid dispensing member 20. This allows the user to selectively apply solution to the surface to be cleaned, for example, to a particularly dirty spot on the surface to be cleaned.

In one embodiment, upon the user's actuation of the actuator 26, cleaning solution flows by gravity from the spot treatment tank 28, through the supply tube 44, to the dispensing nozzle 24. In this embodiment, the actuator 26 is communicatively coupled with a valve to be opened if the actuator 26 is actuated and closed if the actuator 26 is released. The user can selectively actuate the actuator 26 to open the valve to allow passage of the cleaning solution to the dispensing nozzle 24.

In use of the floor cleaner 10, it will be appreciated that it is convenient for the user, if wishing to subject the surface to be cleaned to pre or post-cleaning spot treatment, either localized or over a larger area, to dismount the fluid dispensing member 20 from the body portion 14 and wield it remote from the floor cleaner 10 as required to apply the liquid where needed. After use, the fluid dispensing member 20 can be returned to its mounted position on the body portion 14.

Figure 8:
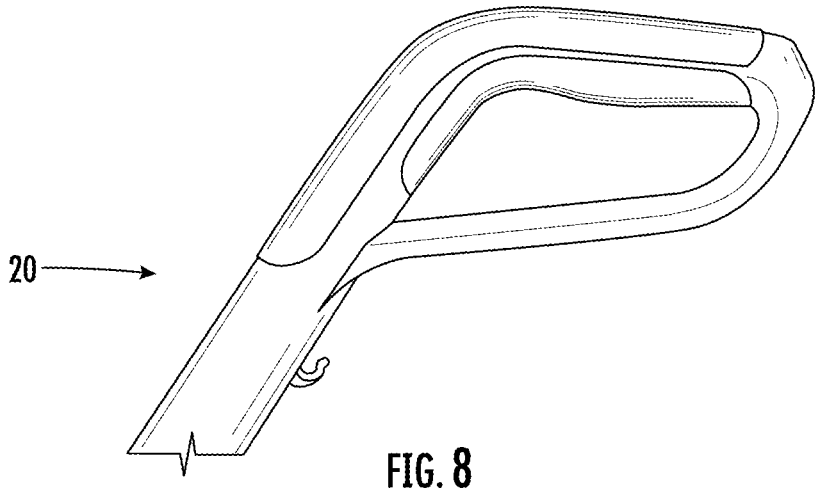
FIG. 8 illustrates the handle assembly with an actuator in the retracted position.
Figure 8A:
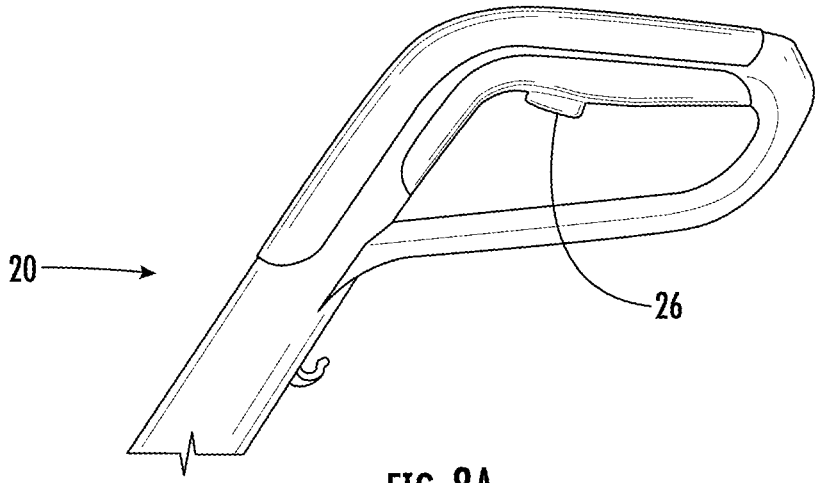
FIG. 8*a* illustrates the handle assembly with an actuator in the extended position.
Figure 9:
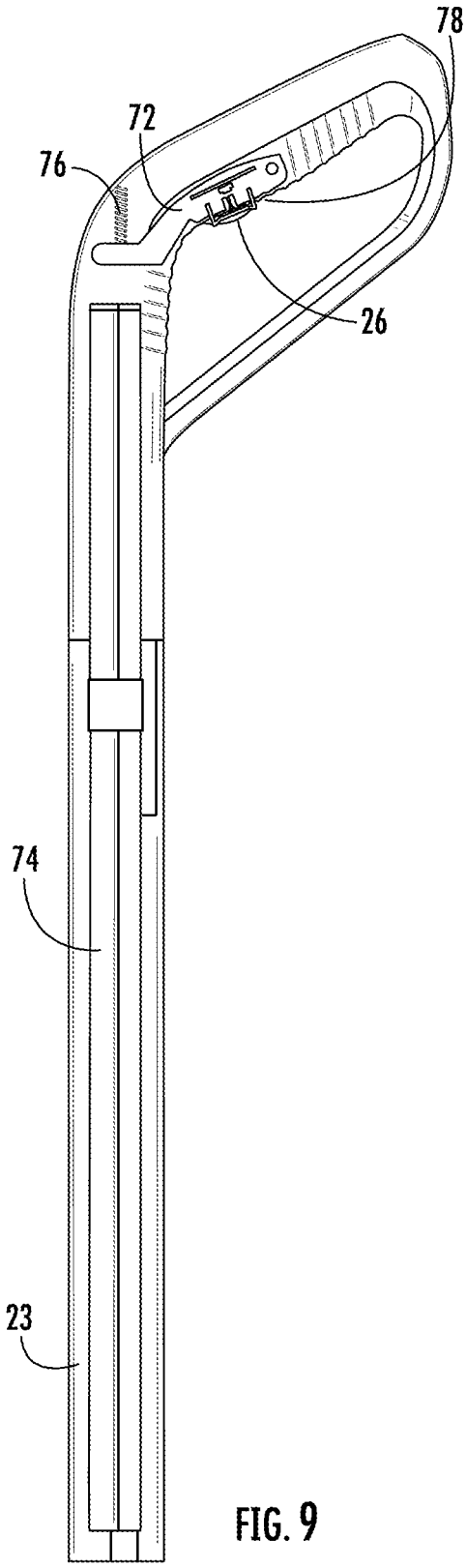
FIG. 9 illustrates a cross-sectional view of the handle assembly.
Figure 9A:
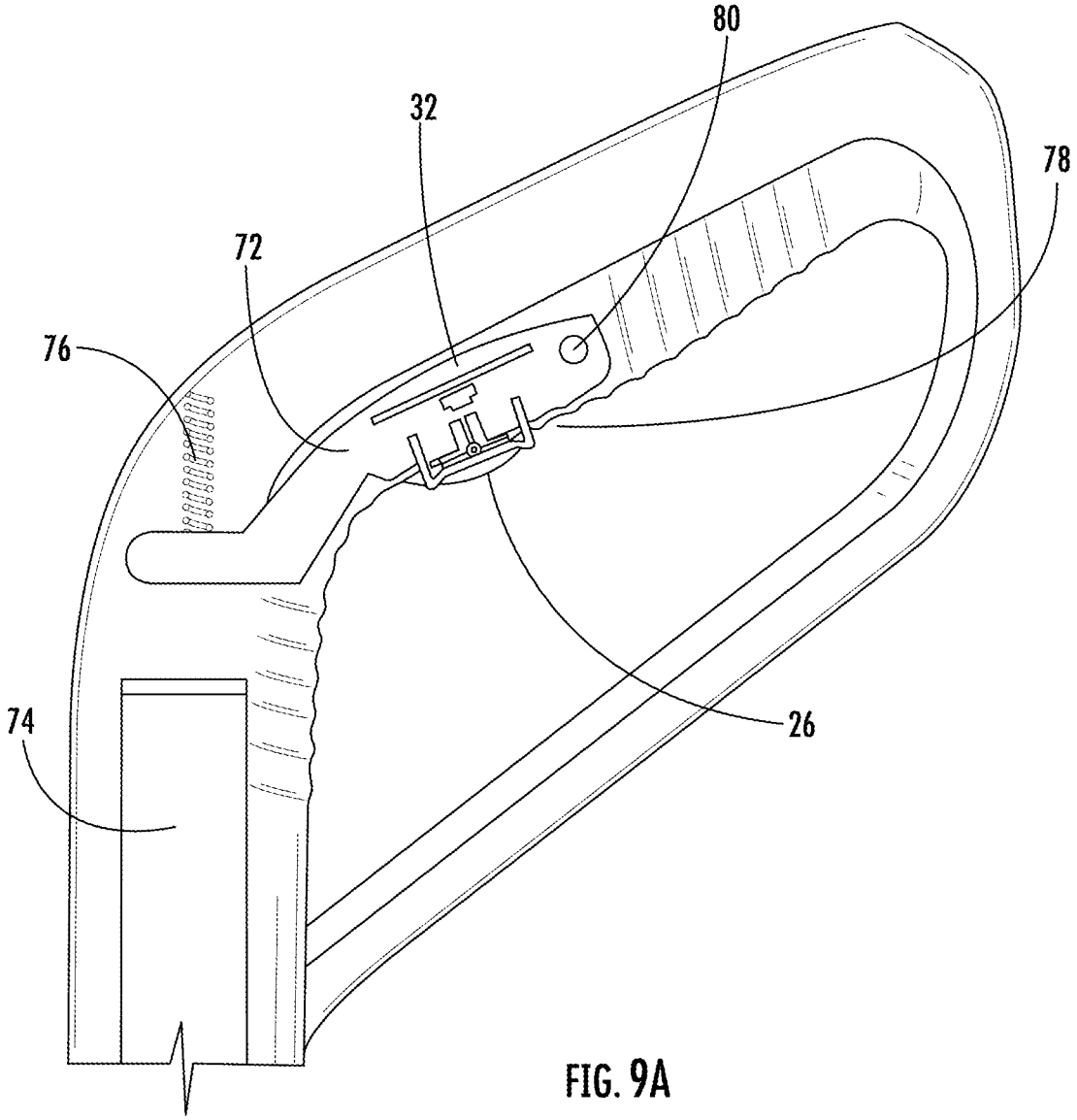
FIG. 9*a* illustrates a cross-sectional view of a grip portion of the handle assembly.

In one embodiment illustrated in FIGS. 8 and 8*a*, the actuator 26 on the handle assembly 20 is accessible when the handle 20 is removed from the body portion 14 in the second position, and retracted into the grip portion 22 when the handle 20 is installed on the body portion 14 in the first position. As shown in FIGS. 9 and 9*a*, the actuator 26 and switch 32 are attached to a carriage assembly 72 that is pivotally mounted in the grip portion and movable between a carriage first position and a carriage second position. When the carriage assembly 72 is in the carriage second position, the actuator 26 is extended through an aperture 78 in the grip, operable as an actuator in a position accessible to the user. When the carriage assembly 72 is in the first position, the actuator 26 is retracted into the aperture 78 in the grip and not operable as an actuator, being not accessible to the user. A push rod 74 is positioned in the wand 23 and configured to axially move within the wand 23 to press the carriage assembly 72 from the carriage second position to the carriage first position. The push rod 74 is configured to engage with the body portion 14 when installed on the body portion such that the push rod 74 is displaced upwardly toward the grip portion 22, moving the carriage assembly 72. A spring 76 is provided in the grip to press the carriage assembly 72 toward the carriage second position. The push rod 74 presses the carriage assembly 72 against the force of the spring 76 into the carriage first position. When the handle assembly 20 is removed from the body portion 14 releasing the push rod 74, the force of the compressed spring 76 presses the assembly 72 and actuator 26 to rotate about a pivot 80, and moves the actuator 26 through the aperture 78 of the grip 22, and holds the actuator in a position that is accessible to the user. Recessing the spot cleaning actuator 26 when the handle assembly 20 is installed on the body portion 14 reduces confusion of the user about solution distribution when the floor cleaner 10 is used in the inclined use position.

Figure 11:
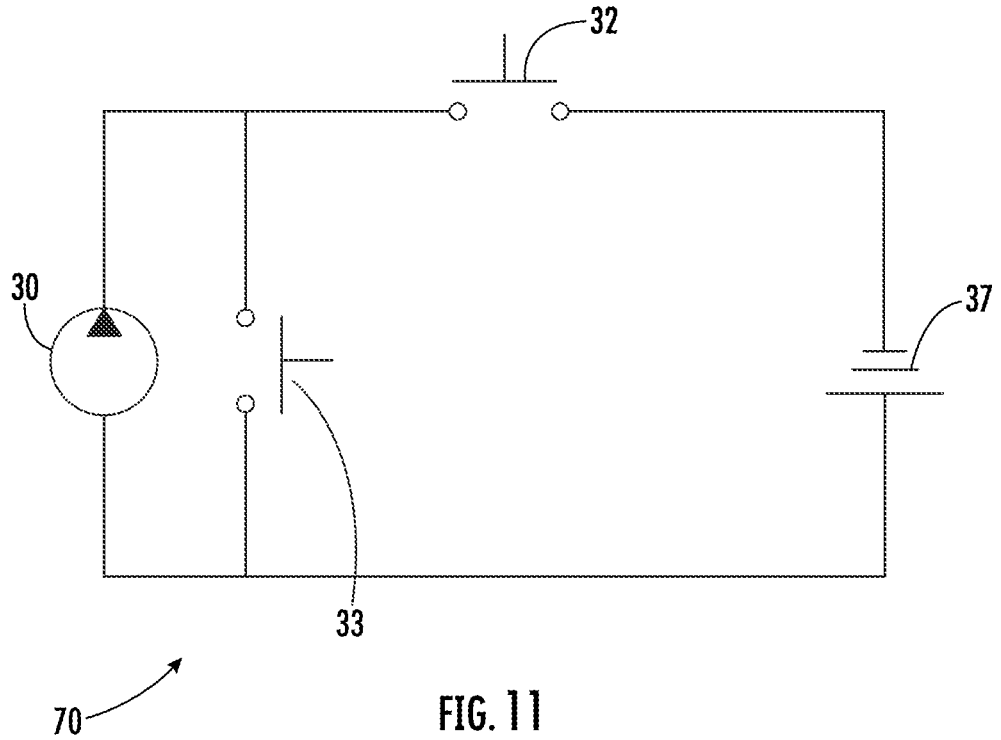
FIG. 11 is a schematic diagram of the handle assembly circuit representing the handle assembly in a second position and a button in an actuated position.
Figure 12:
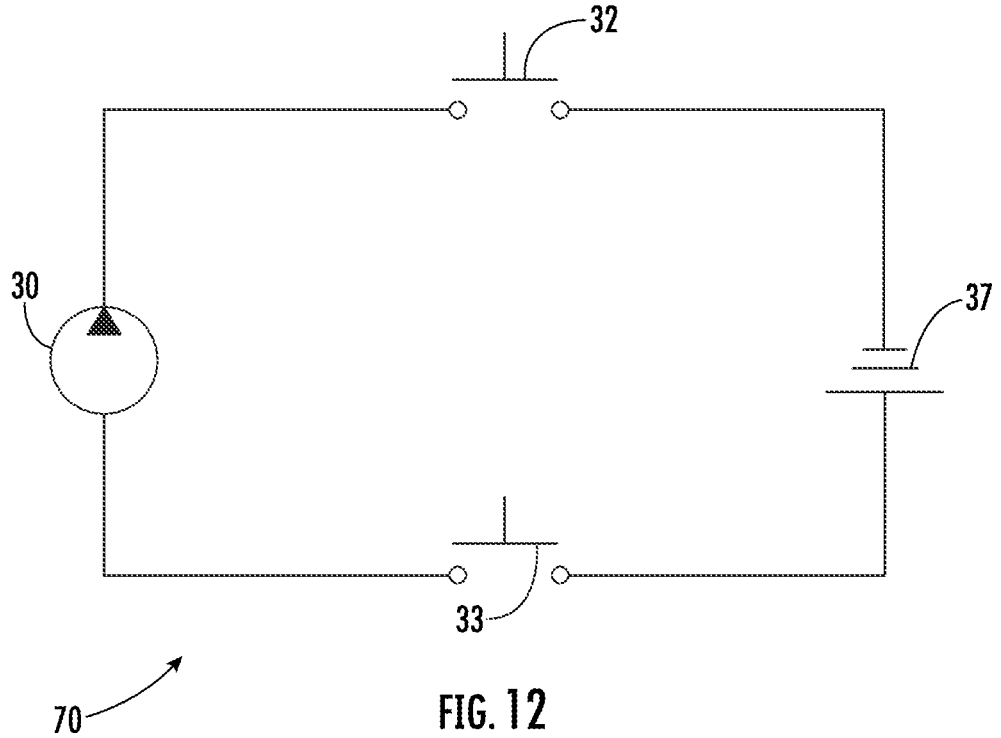
FIG. 12 is a schematic diagram of the handle assembly circuit representing the handle assembly in a second position and a button in a non-actuated position.
Figure 13:
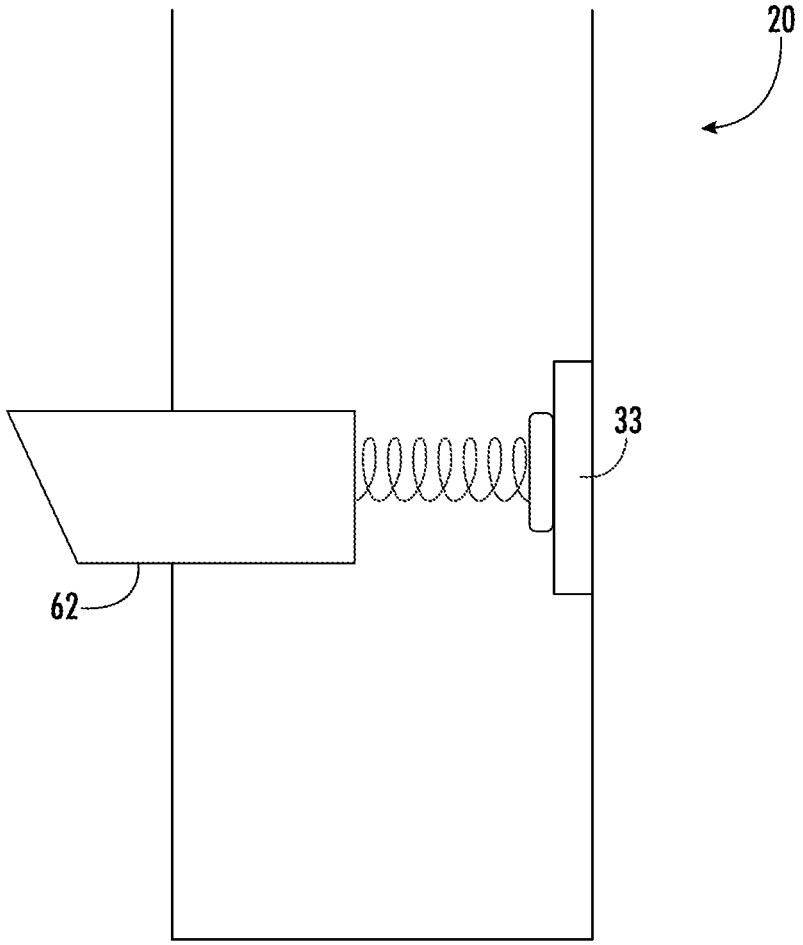
FIG. 13 is a schematic diagram showing the handle assembly in a second position.

As schematically illustrated in FIGS. 11 and 12, the handle assembly 20 includes an electrical circuit 70 connecting the user-activated switch 32 controlled by the actuator 26, the battery 37, and the pump 30. The switch 32 is open when the actuator 26 is not actuated, and closed when the actuator 26 is actuated. Additionally, the handle assembly 20 and the electrical circuit 70 may be configured to include a lock-out that prevents the dispensing nozzle 24 from distributing solution when the handle assembly 20 is installed on the body portion in the first position. In one embodiment, the lock-out includes a second switch 33 that is closed when the handle assembly 20 is removed from the body portion in the second position, and is open when the handle assembly 20 is installed on the body portion in the first position. When both switches 32, 33 are closed, the circuit is activated and capable of distributing solution from the dispensing nozzle 24. When either of the switches 32, 33 is open, the circuit is deactivated, and solution is not distributed. As used in this specification and appended claims, a switch being "open" is not necessarily a physical discontinuity in a circuit, but more generally means disabling a function or operation by an electrical disconnection, electrical connection, software instruction, firmware operation, or other control. As used in this specification and appended claims, a switch being "closed" is not necessarily a physical continuity in a circuit, but more generally means enabling a function or operation by an electrical connection, electrical disconnection, software instruction, firmware operation, or other control.

Figure 14:
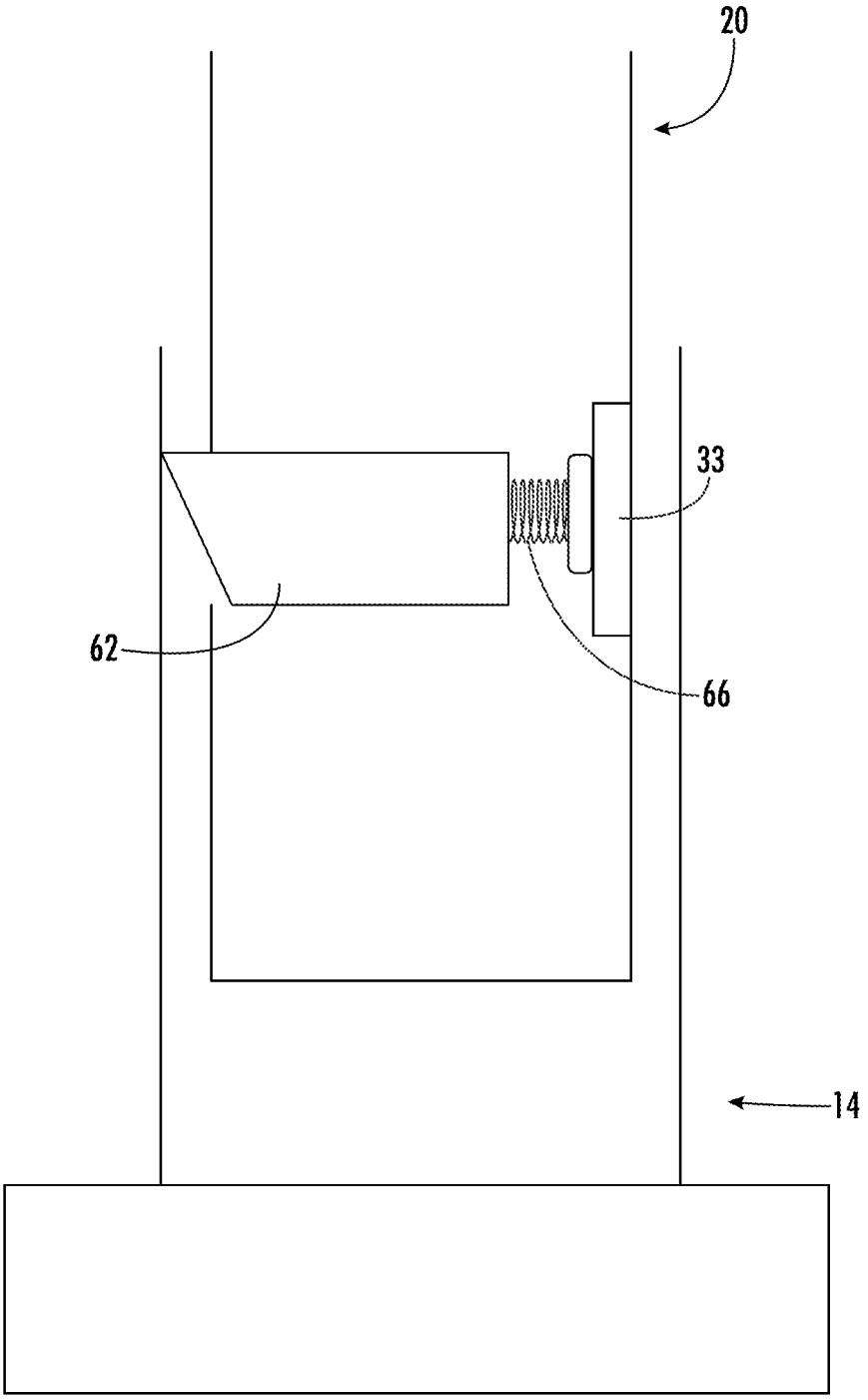
FIG. 14 is a schematic diagram showing the handle assembly in a first position inside a body portion of the floor cleaner.

As schematically illustrated in FIGS. 14 and 15, in one embodiment, the handle assembly 20 includes a button 62 positioned adjacent the second switch 33 and pressed by a spring 66 away from the second switch 33. The button 62 is positioned on the handle assembly 20 and configured such that the button 62 is pressed against the force of the spring 66 when the handle assembly 20 is attached to the body portion 14 to activate the second switch 33. In this embodiment, the second switch 33 is wired in parallel to the pump (FIG. 11). When the handle assembly 20 is removed from the body portion 14, the spring 66 presses the button 62 away from the second switch 33 to enable the pump 30 and extend the button 62 outside of the handle assembly 20 (FIG. 14). When the handle assembly 20 is re-inserted into the interior 42 of the body portion, the button 62 is pressed by the body portion 14 to activate the second switch 33 and disable the pump 30. In another embodiment, the second switch 33 is in series with the pump 30 (FIG. 12), and the button 62 is configured with a mechanism to open the second switch 33 to disable the pump 30.

In operation, a user operating the floor cleaner 10 can steer the base 12 of the floor cleaner 10 along the surface to be cleaned using the handle assembly 20 in the first position. In one embodiment, the user steers the base 12 of the floor cleaner using the grip portion 22 of the handle assembly 20. In another embodiment, the user steers the base 12 of the floor cleaner independent of interaction with the grip portion 22 of the fluid dispensing member 20. A user can apply a spot treatment to the surface to be cleaned when the handle assembly 20 is in the second position. To move the handle assembly 20 to the second position, the user actuates the release button 40 to release the latch 38 and pulls the handle assembly 20 away from the body portion 14. Upon removing the handle assembly 20, the user can apply a spot treatment to the surface to be cleaned by pressing the actuator 26 on the handle assembly 20 to distribute solution from the dispensing nozzle 24.

Further it is understood that although the disclosure is described herein in relation to the spot treatment of a carpet or the like with a cleaning fluid, it may also be applicable to use with other treatment fluids, e.g. a post-cleaning protective (e.g. stain resistant) and/or fragrancing fluid. In various embodiments, the fluid could be in the form of a powder rather than a liquid.

Although mainly intended for use with, and described herein in relation to, an extractor carpet cleaning machine, the invention may also find application in relation to hard floor cleaners, mops, or other extractor or non-extractor floor cleaners.

Various features and advantages of the invention are set forth in the following claims.

What is claimed is:

1. A floor cleaner comprising:

a body having a fluid recovery system including:

a suction nozzle having a suction inlet, a recovery tank in fluid communication with the suction nozzle by a fluid passageway, and a suction source configured to draw fluid from the suction nozzle to the recovery tank;

a fluid dispensing member selectively releasably attached to the body, the fluid dispensing member including:

a grip, a fluid supply tank, a dispensing nozzle in fluid communication with the supply tank, a pump connecting the supply tank to the dispensing nozzle, a power source, and an actuator electrically connected to the power source and the pump;

wherein the pump is configured to dispense fluid through the dispensing nozzle when the dispensing member is released from the body and the actuator is actuated by a user wherein the fluid dispensing member is untethered when released from the body.

2. The floor cleaner of claim 1, wherein the power source is a battery in the fluid dispensing member.

3. The floor cleaner of claim 1, further comprising a base, wherein the suction nozzle is provided in the base.

4. The floor cleaner of claim 3, the body including an upright portion pivotally mounted to the base, the upright portion movable between an upright storage position and an inclined floor cleaning position.

5. The floor cleaner of claim 4, the fluid dispensing member attachable to the body to steer the floor cleaner along the surface to be cleaned as a handle when the dispensing member is attached to the body.

6. The floor cleaner of claim 1, wherein the pump is an electric pump.

7. The floor cleaner of claim 1, wherein the fluid dispensing member is configured to not deliver solution from the fluid supply tank through the dispensing nozzle when the fluid dispensing member is attached to the body.

8. The floor cleaner of claim 1 wherein the fluid dispensing member includes an upper portion and a lower portion, and wherein the dispensing nozzle is positioned in the lower portion.

9. The floor cleaner of claim 8, wherein the lower portion includes a wand, and the dispensing nozzle is positioned in the wand.

10. The floor cleaner of claim 1, wherein the fluid dispensing member is operable independent of the suction nozzle.

11. The floor cleaner of claim 1, wherein the fluid dispensing member is movable independent of the suction nozzle.

12. A floor cleaner comprising:

a base movable over a surface to be cleaned;

a body connected to the base;

a first fluid distribution system supported by the base or the body, the first fluid distribution system including:

a first fluid supply tank, a first dispensing nozzle in fluid communication with the first fluid supply tank, the first dispensing nozzle configured to provide a fluid to a surface to be cleaned;

a fluid recovery system; and a second fluid distribution system independent of the first fluid distribution system and selectively releasably attached to the body, the second fluid distribution system including:

a grip, a second fluid supply tank, a second dispensing nozzle in fluid communication with the second supply tank, a pump connecting the second supply tank to the second dispensing nozzle, a power source, and an actuator electrically connected to the power source and the pump, wherein the pump is configured to dispense fluid through the second dispensing nozzle when the second fluid distribution system is released from the body and the actuator is actuated by a user.

13. The floor cleaner of claim 12, the second fluid distribution system being untethered when released from the body.

14. The floor cleaner of claim 13, wherein the power source is a battery in the second fluid distribution system.

15. The floor cleaner of claim 13, the body including an upright portion pivotally mounted to the base, the upright portion movable between an upright storage position and an inclined floor cleaning position.

16. The floor cleaner of claim 15, the second fluid distribution system attachable to the body to steer the floor cleaner along the surface to be cleaned as a handle when the second distribution system is attached to the body.

17. The floor cleaner of claim 13, wherein the fluid recovery system includes a mop pad or other absorbent media disposed on the base.

18. The floor cleaner of claim 13, wherein the fluid recovery system includes a suction nozzle having a suction inlet disposed on the base, a recovery tank in fluid communication with the suction nozzle by a fluid passageway, and a suction source configured to draw fluid from the suction nozzle to the recovery tank.

19. The floor cleaner of claim 13, wherein the pump is an electric pump.

20. The floor cleaner of claim 13, wherein the second fluid distribution system is tethered to the body by an electrical connection, wherein the power source includes the electrical connection.

21. The floor cleaner of claim 13, wherein the second fluid distribution system is configured to not deliver solution from the second fluid supply tank through the second dispensing nozzle when the second fluid distribution system is attached to the body.

22. The floor cleaner of claim 13 wherein the second fluid distribution system includes an upper portion and a lower portion, and wherein the second dispensing nozzle is positioned in the lower portion.

23. The floor cleaner of claim 22, wherein the lower portion includes a wand, and the second dispensing nozzle is positioned in the wand.

24. The floor cleaner of claim 13, wherein the second fluid distribution system is operable independent of the fluid recovery system.

25. The floor cleaner of claim 13, wherein the second fluid distribution system is movable independent of the fluid recovery system.

* * * * *